United States Patent [19]

Beckerer, Jr.

[11] Patent Number: 4,842,482

[45] Date of Patent: Jun. 27, 1989

[54] PADDLE CONSTRUCTION

[76] Inventor: Frank S. Beckerer, Jr., 40 Dock Rd., Milford, Conn. 06460

[21] Appl. No.: 232,278

[22] Filed: Aug. 15, 1988

[51] Int. Cl.[4] ..... B63H 16/04

[52] U.S. Cl. ..... 416/70 R; 416/74; 440/101

[58] Field of Search ..... 416/70 R, 63, 74, 69, 416/197 R, 235, 236 R; 440/101

[56] References Cited

U.S. PATENT DOCUMENTS

| | | | |
|---|---|---|---|
| 560,980 | 5/1896 | Dunlap | 416/74 |
| 738,053 | 9/1903 | Murdock | 416/74 |
| 2,526,863 | 10/1950 | Gilliam | 416/70 |
| 2,527,040 | 10/1950 | Swenson et al. | 416/74 |
| 3,117,325 | 1/1964 | Shelton | 416/70 X |
| 4,233,925 | 11/1980 | Proctor | 440/101 |
| 4,303,402 | 12/1981 | Gooding | 416/74 X |
| 4,493,663 | 1/1985 | Richmond | 416/70 R X |
| 4,646,483 | 3/1987 | Mangan | 416/197 R X |

FOREIGN PATENT DOCUMENTS

| | | | |
|---|---|---|---|
| 2604597 | 8/1977 | Fed. Rep. of Germany | 440/101 |
| 304038 | 12/1932 | Italy | 440/101 |
| 633436 | 5/1963 | Italy | 440/101 |
| 158193 | 9/1982 | Japan | 440/101 |

*Primary Examiner*—Everette A. Powell, Jr.
*Attorney, Agent, or Firm*—H. Gibner Lehmann; K. Gibner Lehmann

[57] ABSTRACT

A high-efficiency paddle construction having a blade and a stem extending therefrom, and wherein the blade has a pair of opposite, longitudinally extending edges, with flanges extending along the edges. The arrangement is such that there is provided resistance to flow past the side edges when the paddle is being used. There is thus realized improved efficiency, with a consequent reduction in the efford required by the user.

15 Claims, 3 Drawing Sheets

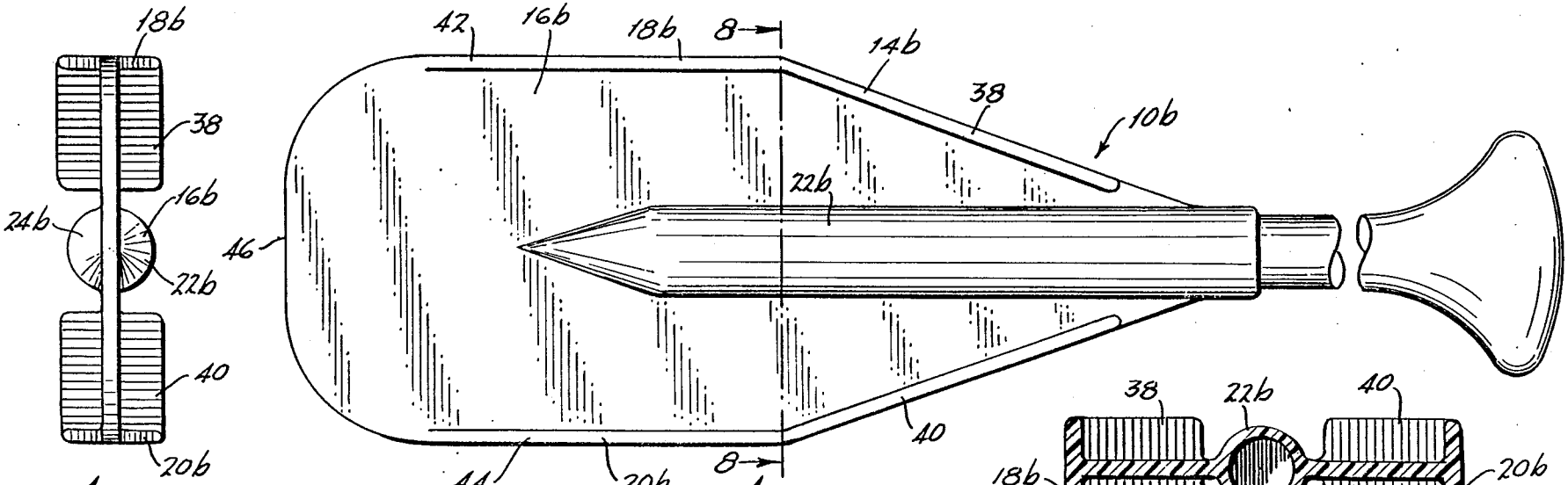
Fig. 6
Fig. 7
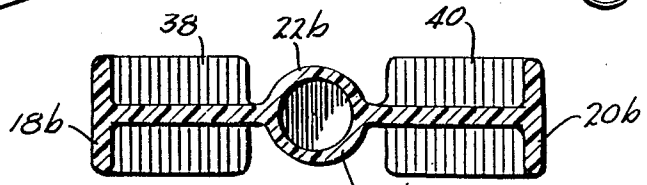
Fig. 8
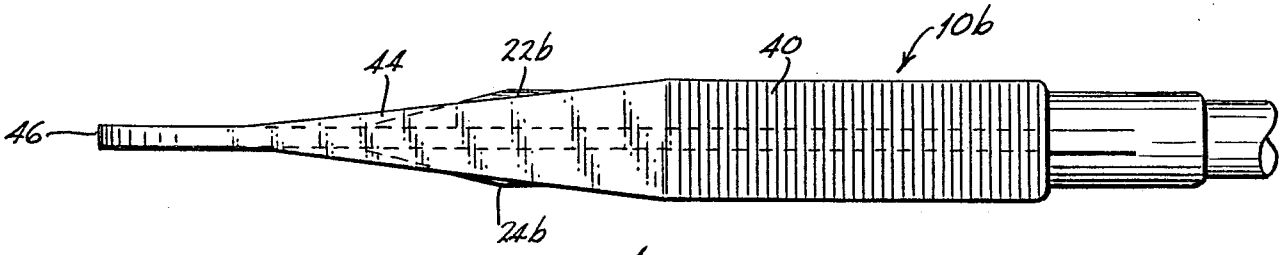
Fig. 9

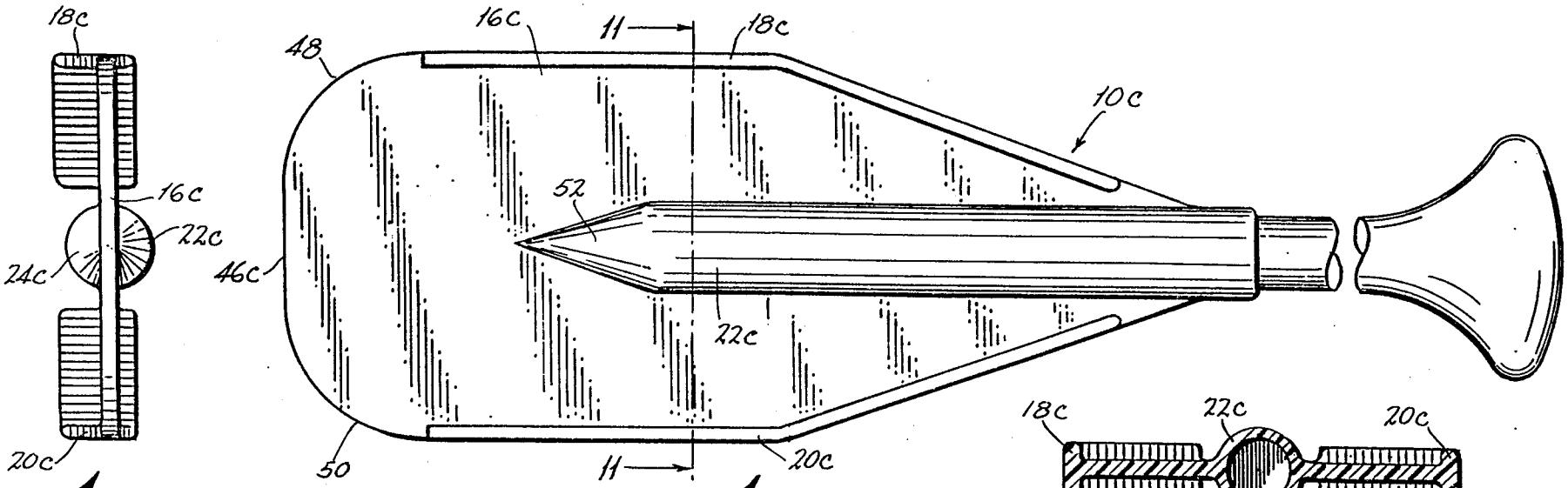
Fig. 10
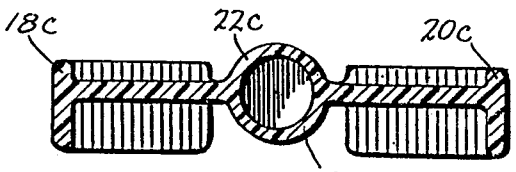
Fig. 11
Fig. 12

PADDLE CONSTRUCTION

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates to improvements in paddles.

2. Description of the Related Art including Information Disclosed UNDER 37 CFR §§1.97–1.99

Prior paddle constructions were most ofte fabricated from wood, constituted as a single piece having an elongate handle and a blade with the area of the blade at the longitudinal centerline being thick and tapering to a lesser dimension as the opposite side edges of the blade were approached.

While such an arrangement has found wide acceptance, I have discovered that as the paddle is being drawn back on a pull stroke, energy is wasted as a consequence of the water or substance which is being paddled or stirred flowing past such edges. As presently understood, such by-passing does little to effect the desired end result, as to propel a water craft, or to propel liquid or granular substance in a tank, vessel, or trough; instead it merely creates turbulence and leads to poor efficiency. It is my belief that there was thus wasted a substantial amount of the work that was done in employing conventional paddles. In consequence, prior known paddles have up to the present represented at best a compromise as far as efficiency is concerned.

SUMMARY OF THE INVENTION

The above disadvantages and drawbacks of prior paddles are largely obviated by the present invention, which has for one object the provision of a novel and improved paddle which is both simple in construction and characterized by a much higher efficiency than conventional paddles, thus requiring substantially less total effort or work.

A related object of the invention is to provide an improved paddle as above set forth, wherein part or all of the device can be readily molded of plastic or cast, at relatively low cost.

Still another object of the invention is to provide an improved paddle of the kind indicated, which is characterized by high strength, thus making it resistant to inadvertent breakage.

Yet another object of the invention is to provide an improved paddle as outlined above, which is light in weight and thus easy to use and manipulate.

The above objects are accomplished by the provision of a a paddle construction comprising a blade and a manipulator stem extending from the blade, said blade having a pair of opposite, longitudinally extending side edges, and having flanges extending along said side edges to impede the flow of material past the same when the paddle is being used.

The paddle can advantageously be constituted of cast substance, such as molded plastic in order to reduce the overall cost. In addition, increased strength is realizeable over that obtainable with conventional wooden paddles.

Significantly higher efficiency is also achieved, without increasing the total effort or work required in the use of the paddle.

The disclosed constructions have special applicability to the field of boating, as for example, such as for propelling a canoe or other craft. In addition, they have applicability as stirring devices, for liquids, granular or particulate matter, powders, or other substances which are susceptible of flowing or being mixed or propelled.

Other features and advantages will hereinafter appear.

BRIEF DESCRIPTION OF THE DRAWINGS

FIG. 6 is a top plan view of a further modified paddle, constituting still another embodiment of the invention.

FIG. 7 as a left end elevation of the paddle of FIG. 6.

FIG. 8 is a transverse section of the paddle of FIGS. 6 and 7, taken along the line 8—8 of FIG. 6.

FIG. 9 is a front elevation of the paddle of FIGS. 6–8.

FIG. 10 is a top plan view of a still further modified paddle, constituting yet another embodiment of the invention.

FIG. 11 is a transverse section of the paddle of FIG. 10, taken along the line 11—11 of FIG. 10, and FIG. 12 is a left end elevation of the paddle of FIGS. 10 and 11.

DESCRIPTION OF THE PREFERRED EMBODIMENTS

Figure 1:
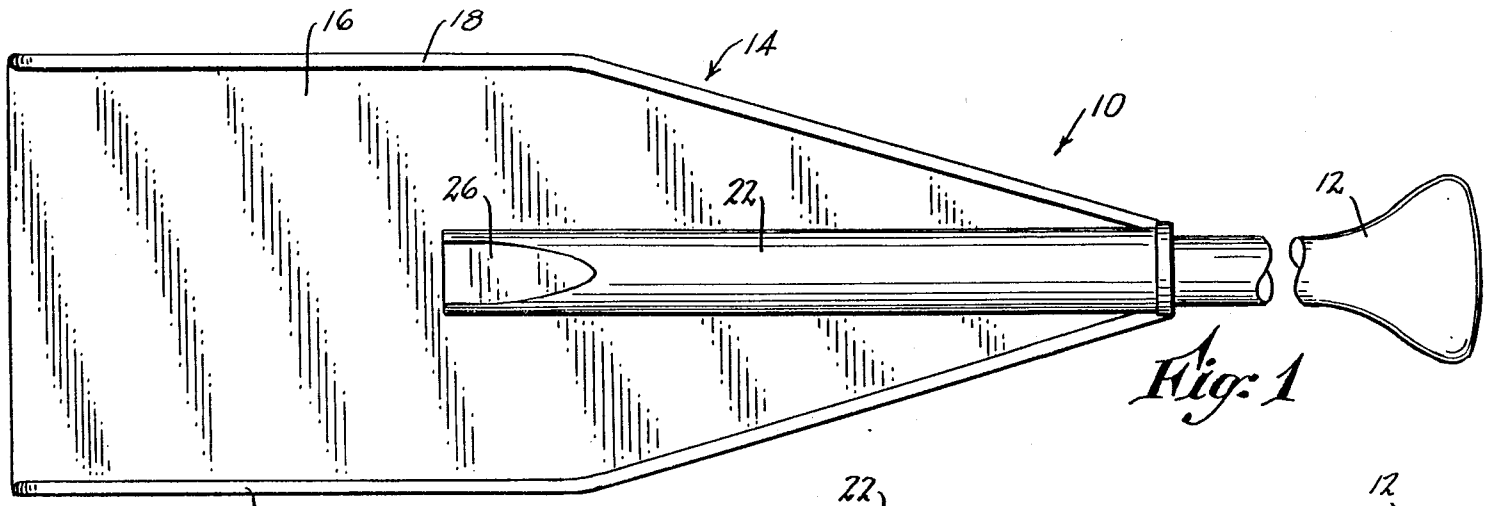
FIG. 1 is a top plan view of an improved, high-efficiency paddle construction made in accordance with the invention.
Figure 2:
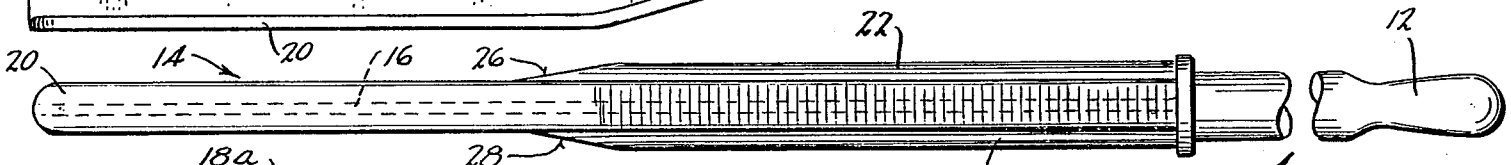
FIG. 2 is a side elevation of the paddle of FIG. 1.
Figure 3:
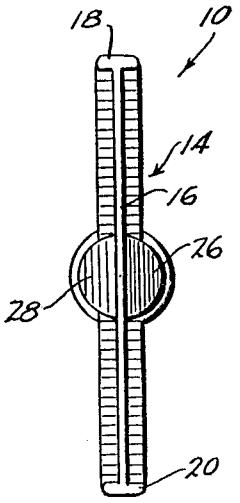
FIG. 3 is a left end elevation of the paddle of FIGS. 1.

By way of example, referring first to FIGS. 1–3 and in accordance with the present invention there is illustrated a novel and improved, high-efficiency paddle intended for use in propelling a water craft such as a canoe, or as a stirrer for liquid, granular or similar material contained in a tank, container or trough, the device being designated generally by the numeral 10, and comprising a handle 12 and a blade 14. The blade has a substantially flat central body portion 16.

In the case of use as a stirrer, the device has applications in industrial, commercial or residential areas.

In accordance with the present invention, for the purpose of improving the efficiency of the paddle 10, there are disposed at the opposite longitudinal edges of the blade 14 two flanges 18, 20, respectively, preferably molded integral with the flat body portion 16. The flanges extend generally perpendicular to the body portion 16, as shown in FIG. 3. The juncture of the handle and blade form two semi-cylindrical stem formations 22, 24. The stem formations 22, 24 terminate in flats 26, 28, as shown.

The blade 16 is comprised of a rectangular portion one edge of which is unobstructed and constitutes the leading edge of the paddle. The blade 16 also has oppositely disposed triangular portions on opposite sides of the stem formations 22, 24 of the handle 12, such triangular areas of the blade constituting an effective reinforcing means which connects the formations 22, 24 to the rectangular working area of the blade and tends to minimize the likelihood of breakage of the handle from the blade.

The paddle of FIGS. 1–3 is substantially symmetrical about a plane passing through the body portion 16 in FIG. 3. The provision of the flanges 18, 20 reduces the amount of material which can freely by-pass the edges of the paddle when it is being drawn back in a pull stroke. A scoop effect is thus realizeable, resulting in a surprising increase in efficiency. The increase has been demonstrated in actual tests recently performed, wherein there was made a comparison of a unit similar to that of FIGS. 1–3 with respect to a conventional paddle which did not have the flanges 18, 20.

The device of FIGS. 1–3 can be advantageously molded as a single integral piece in a relatively simple mold cavity. Alternately, the blade portion can be molded as one piece, and a tubular metal or plastic handle secured thereto.

Figure 4:
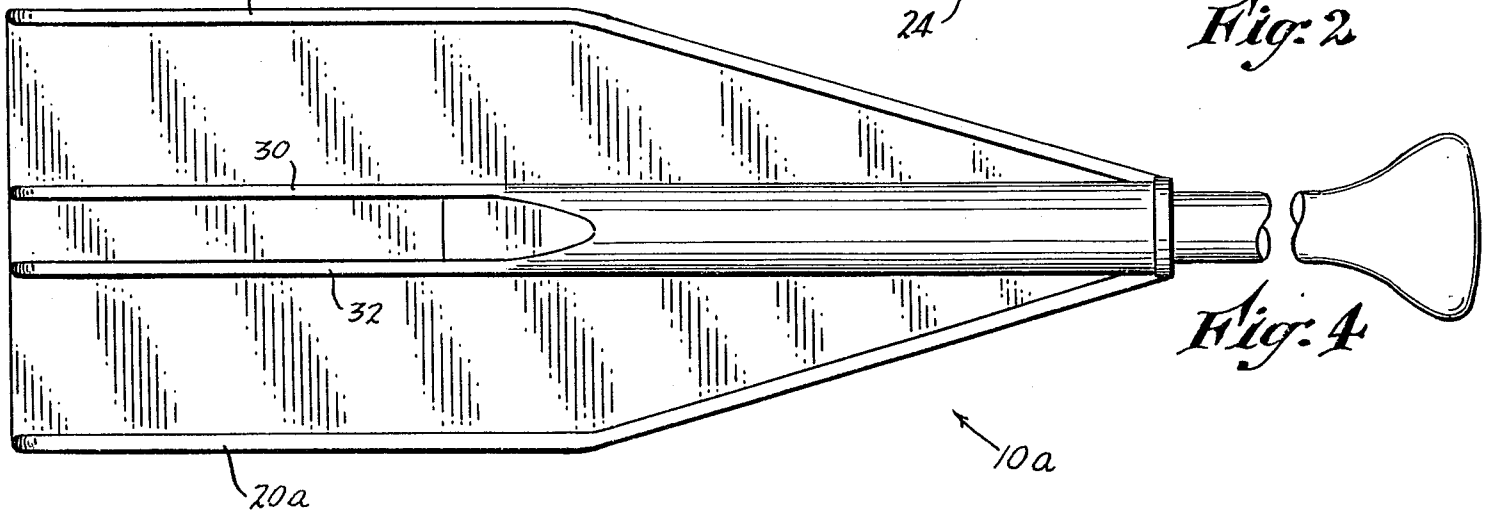
FIG. 4 is a top plan view of a modified paddle, constituting another embodiment of the invention.
Figure 5:
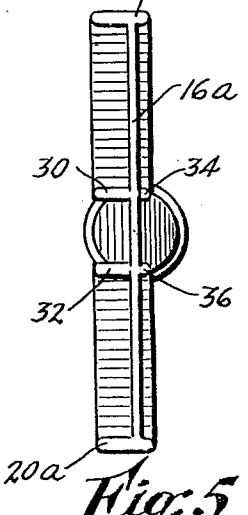
FIG. 5 is a left end elevation of the paddle of FIG. 4.

Another embodiment of the invention is shown in FIGS. 4 and 5, wherein like reference numerals having the suffix "a" have been assigned to similar parts.

By the invention, the paddle 10*a* has, at its opposite longitudinal edges, two flanges 18*a*, 20*a*, being of increased dimension or width as compared to the flanges 18, 20 respectively. Also, ribs 30, 32, 34 and 36 are provided on opposite sides of the body portion 16*a*. These function to provided added stiffness to the paddle; in addition, they tend to further restrict lateral flow across the body portion 16*a* as the paddle is being used on a pull stroke, thus supplementing the resistance provided by the flanges 18*a* and 20*a*. The scoop effect noted above is more pronounced when the side of the body portion having the wide part of the flanges 18*a*, 20*a* is employed, and less pronounced when the opposite side is used. Different stroke characteristics are thus incorporated in a single paddle, and can be interchanged merely by turning the paddle 180°.

Still another embodiment of the invention is shown in FIGS. 6–9, wherein like reference numerals having the suffix "b" have been assigned to similar parts.

By the invention there is provided a modified paddle 10*b* having disposed at the opposite longitudinal edges of the blade 14*b* two flanges 18*b*, 20*b*, respectively, preferably molded integral with the flat body portion 16*b*. The flanges extend generally perpendicular to the body portion 16*b*, as shown in FIG. 7. The juncture of the handle and blade form two semi-cylindrical stem formations 22*b*, 24*b*. Unlike the construction of FIGS. 1–3, the flanges 18*b* and 20*b* have portions of uniform, finite width adjacent the center of the blade measured longitudinally, which meet or join adjacent portions 42, 44 of tapering width at the locations indicated by their intersections with the line 8—8. The widths preferably taper from the finite dimensions of the uniform portions 38, 40 to zero adjacent the transverse edge 46 of the blade, as shown in FIG. 6. This construction has the advantages that the amount of material is reduced over that required for the first embodiment, and that the weight of the paddle is less, all with little sacrifice in the desired "scoop" effect of the paddle.

Yet another embodiment of the invention is shown in FIGS. 10–12, wherein like reference numerals having the suffix "c" have been assigned to similar parts.

By the invention, the paddle 10*c* has, at its opposite longitudinal edges, two flanges 18*c*, 20*c* of increased dimension or width as compared to the flanges 18, 20 respectively of FIGS. 13. As in the previous embodiments, the scoop effect noted above is more pronounced when the side of the body portion 16*c* having the wide part of the flanges 18*c*, 20*c* is employed, and less pronounced when the opposite side is used. Accordingly different stroke characteristics can also be incorporated in this paddle, by reversing or turning it 180°.

By the present invention, the flanges 18*c*, 20*c* terminate short of the end or transverse edge 46*c* of the paddle as shown in FIG. 10. Also, the edge 46*c* has a straight central portion devoid of obstructions, which merges into two curved portions 48, 50 respectively, that terminate at the ends of the flanges 18*c*, 20*c*. Flow of material past the edge 46*c* in a direction parallel to the longitudinal edges of the paddle is thus essentially unimpeded, which is important from the standpoint of minimizing undesirable drag on the paddle.

The juncture of the handle and blade form two semi-cylindrical stem formations 22*c*, 24*c*. As opposed to the structure of the first embodiment, the stem formations 22*c* 24*c* terminate in semi-conical surfaces 52, one of which is shown in FIG. 10 and both of which are illustrated in FIG. 12 (no numbers).

The advantages noted above in connection with the previous constructions are carried over to the construction illustrated in FIGS. 10–12, as can be readily understood.

The efficiency of the disclosed constructions has been found to be significantly greater than that of any prior known paddle, as determined by tests performed with actual working models; accordingly the disclosed devices are thus seen to represent a distinct advance and improvement in the field of paddles and paddle-like structures.

The paddles which have been described and illustrated have applicability to the field of boating, as for example, propelling a canoe or other craft. They also have utility as stirrers for liquids, granular or particulate matter, powders, or other substances which are susceptible of being mixed in a vat or vessel, or otherwise propelled as along a trough.

Variations and modifications are possible without departing from the spirit of the invention.

Each and every one of the appended claims covers an aspect of the invention which is separate and distinct from all others, and accordingly it is intended that each claim be treated as such when examined in light of the prior art devices in any determination of novelty or validity.

What is claimed is:

1. A paddle construction comprising, in combination:

(a) a blade, (b) an elongate slender stick-like handle extending from the blade, (c) said blade having a pair of opposite, longitudinally extending edges and having flanges extending along said edges to impede the flow of fluid from said blade laterally past said edges, (d) said handle having a protuberant mounting portion of greater thickness than the blade, which mounting portion is affixed to the blade at points thereon which are located intermediate opposite terminal portions of said longitudinally extending edges, (e) said blade having an unobstructed transverse free leading edge at the location thereon which is opposite said handle, and (f) reinforcement means connecting said mounting portion of the handle to the blade to minimize the likelihood of breakage of the handle from the blade.

2. A paddle as set forth in claim 1, wherein:
(a) said mounting portion of the handle extends forwardly toward said free leading blade edge and along both opposite sides of the blade for a predetermined distance between the said longitudinally extending edges.

3. A paddle as set forth in claim 1, wherein:
(a) said mounting portion of the handle extends along a median area of the blade.

4. A paddle as set forth in claim 1, wherein:
(a) the reinforcement means comprises tapered portions of the blade.

5. A paddle as set forth in claim 1, wherein:
(a) the blade has a portion of substantially rectangular configuration between its free edge and the mounting portion of the handle,
(b) said blade having substantially triangular portions on each side of the mounting portion of the handle.

6. A paddle as set forth in claim 1, wherein:
(a) said flanges taper in height as the free edge of the blade is approached.

7. A paddle as set forth in claim 6, wherein:
(a) the free edge of the blade has a rounded configuration beyond the flanges.

8. A paddle as set forth in claim 1, wherein:
(a) the flanges terminate short of the mounting portion of the handle.

9. A paddle as set fo.ıh in claim 1, wherein:
(a) the handle mounting portion comprises a cylindrical structure permanently affixed to the blade, and a stick-like portion removably carried in the said cylindrical structure.

10. A paddle as set forth in claim 9, wherein:
(a) the blade has a portion of substantially rectangular configuration between its free edge and the mounting portion of the handle,
(b) said blade having substantially triangular portions on each side of the mounting portion of the handle.

11. A paddle as set forth in claim 1, wherein:
(a) the flanges at one side of the blade are of greater height than the flanges at the other side of the blade.

12. A paddle as set forth in claim 1, wherein:
(a) the flanges at one side of the blade are of greater height than the flanges at the other side of the blade,
(b) said flanges terminating short of the mounting portion of the handle.

13. A paddle as set forth in claim 1, wherein:
(a) said blade has ribs projecting from its surface and extending longitudinally between and parallel to the said flanges.

14. A paddle as set forth in claim 1, wherein:
(a) the said flanges project from both sides of the blade in coplanar pairs,
(b) each pair of flanges presenting smooth outer surfaces at the longitudinally extending edges of the blade.

15. A paddle as set forth in claim 1, wherein:
(a) opposite sides of the blade are identical to each other.

* * * * *